US006613146B2

(12) United States Patent
Bolyard, Jr.

(10) Patent No.: US 6,613,146 B2
(45) Date of Patent: Sep. 2, 2003

(54) VARIABLE SPACING STRAND COATING SYSTEM AND MODULAR GUIDE ROLLER THEREFOR

(75) Inventor: Edward W. Bolyard, Jr., Old Hickory, TN (US)

(73) Assignee: Illinois Tool Works Inc, Glenview, IL (US)

( * ) Notice: Subject to any disclaimer, the term of this patent is extended or adjusted under 35 U.S.C. 154(b) by 142 days.

(21) Appl. No.: 09/758,702

(22) Filed: Jan. 11, 2001

(65) Prior Publication Data

US 2002/0088392 A1 Jul. 11, 2002

(51) Int. Cl.[7] ..... B05B 13/02
(52) U.S. Cl. ..... 118/325; 118/305
(58) Field of Search ..... 118/325, 230, 118/234, 314, 305; 427/208.6, 256, 286, 422; 156/244.11, 500, 578; 492/40, 39; 384/417

(56) References Cited

U.S. PATENT DOCUMENTS 2,841,020 A * 7/1958 Van Deventer, IV ..... 384/417
3,125,126 A * 3/1963 Engels ..... 384/417
4,687,477 A 8/1987 Suzuki et al.
4,750,960 A 6/1988 Bubeck
5,735,788 A * 4/1998 Yasutake et al. ..... 492/40
5,766,411 A 6/1998 Wilson
5,964,973 A 10/1999 Heath et al.
6,077,375 A 6/2000 Kwok

OTHER PUBLICATIONS

Nordson Corp., "Non–Woven Systems" (9) website pages, 1998.

* cited by examiner

*Primary Examiner*—Curtis Mayes
*Assistant Examiner*—Y. T. Tadesse
(74) *Attorney, Agent, or Firm*—Donald J. Breh

(57) ABSTRACT

A strand coating apparatus having an applicator head with a coating material dispenser coupled thereto, a strand guide roller coupled to the applicator head adjacent a coating material orifice of the dispenser, the strand guide roller having one or more strand guides each having a corresponding annular groove disposed about a hub, the one or more strand guides disposed and retained between a shoulder flange and removable locking collar of the hub, and in some embodiments one or more spacers are disposed between adjacent strand guides of the strand guide roller.

20 Claims, 5 Drawing Sheets

VARIABLE SPACING STRAND COATING SYSTEM AND MODULAR GUIDE ROLLER THEREFOR

CROSS REFERENCE TO RELATED APPLICATION

The present application is related to U.S. application Ser. No. 09/621,721 filed on Jul. 24, 2000 entitled "Variable Spacing Strand Coating System And Method", assigned commonly with the present application and incorporated by reference herein.

BACKGROUND OF THE INVENTION

The invention relates generally to strand coating systems, and more particularly to variable spacing strand coating systems and guide rollers therefor.

An object of the present invention is to provide novel strand coating systems and guide rollers therefor that overcome problems in and improve upon the prior art.

Another object of the invention is to provide in some embodiments thereof novel strand coating systems and guide rollers therefor that are economical.

Another object of the invention is to provide in some embodiments thereof novel strand coating systems and guide rollers therefor that are reliable.

A further object of the invention is to provide in some embodiments thereof novel strand guide rollers that are configured specifically for a particular application.

Another object of the invention is to provide in some embodiments thereof novel strand coating systems and modular guide rollers therefor having a plurality of spaced apart grooves for guiding corresponding strands.

Another object of the invention is to provide in some embodiments thereof novel strand coating systems and modular guide rollers therefor that may be assembled or configured from a limited set of components to provide different strand guide spacings.

A further object of the invention is to provide in some embodiments thereof novel strand coating systems and guide rollers therefor that may be configured from a limited set of components to accommodate different numbers of strands.

Another object of the invention is to provide in some embodiments thereof novel strand coating systems and guide rollers therefor that are made less susceptible to misalignment by providing no more strand guide grooves than are required for an application.

A more particular object of the invention is to provide in some embodiments thereof novel strand coating applicator guide rollers comprising a hub, a strand guide and in some embodiments a plurality of strand guides disposed in stacked relation about the hub, each of the plurality of strand guides having a groove disposed on an outer surface thereof, the grooves spaced apart along the axis of the hub.

Another more particular object of the invention is to provide in some embodiments thereof novel strand coating apparatuses comprising a coating material dispenser with an orifice coupled to an applicator head, a strand guide roller coupled to the applicator head in spaced apart relation to the coating material dispenser, the strand guide roller having a hub and one or more strand guides disposed thereabout, the strand guides each having an annular groove disposed thereabout and located adjacent the coating material orifice.

Yet another more particular object of the invention is to provide in some embodiments thereof novel modular strand coating applicator guide roller systems comprising a hub having an axial support opening with bearings, the hub having a radial shoulder flange, a collar removably disposed about the hub, the collar spaced axially from the shoulder flange, one or more identical annular strand guides removably disposed in stacked relation about the hub between the shoulder flange and the removable collar, each strand guide having a corresponding annular groove disposed on an outer surface thereof.

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators.

DETAILED DESCRIPTION OF THE INVENTION

Figure 1:
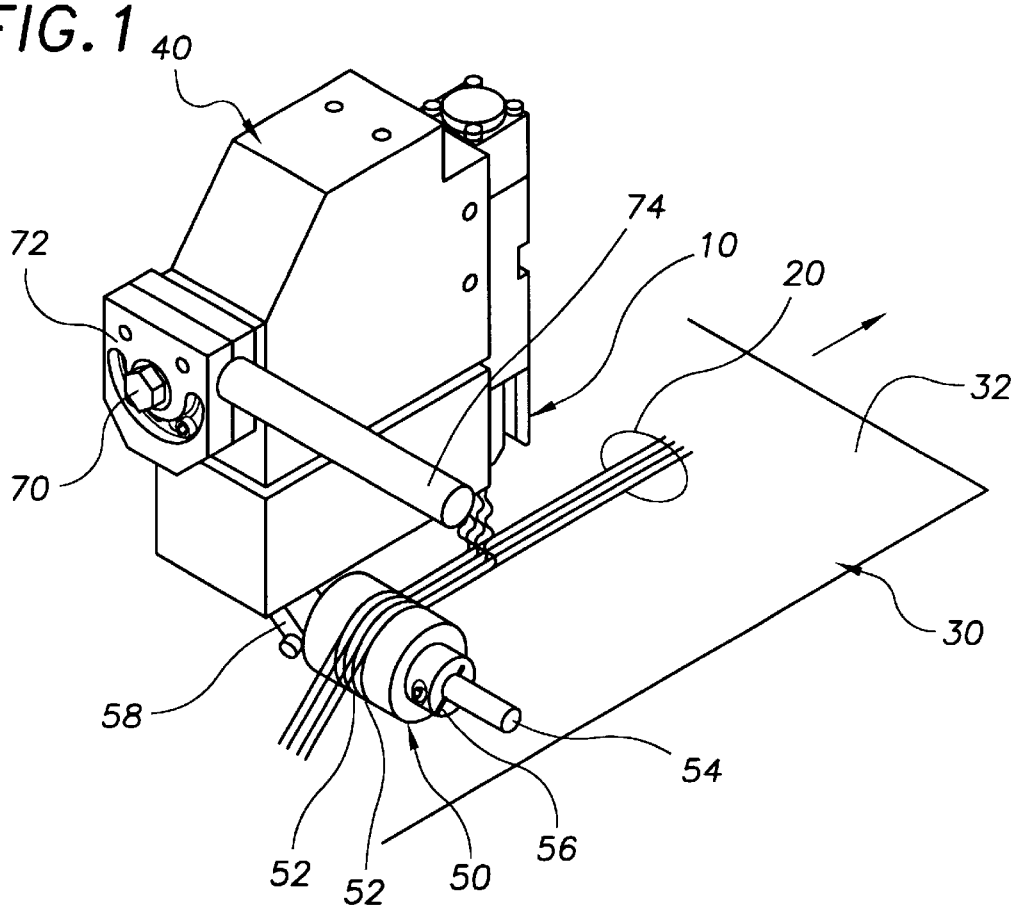
FIG. 1 is a strand coating system according to an exemplary embodiment of the invention.

FIG. 1 illustrates a strand coating system comprising a coating material dispenser 10 for applying coating materials, for example a hot melt adhesive or an atomized substance, onto one or more strands, identified collectively by numeral 20, moving relative thereto.

The strands 20 may for example be elastic rubber or LYCRA materials used in the manufacture of diapers, incontinence pads and hospital garments and other articles. The strands may also be wire or cable, for example a fiber optic cable, or some other elongated member onto which it is desirable to deposit a coating material.

Figure 3:
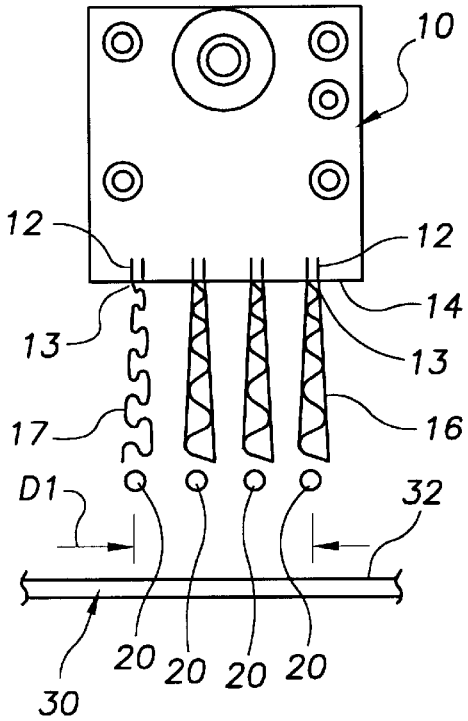
FIG. 3 is a partial view of an exemplary coating material dispenser in a first configuration.

In FIG. 3, the exemplary dispenser 10 includes a plurality of conduits 12, shown only partially and in phantom, terminating at corresponding coating material orifices arranged in a spaced apart series on a side 14 of the dispenser. The orifices of the exemplary dispenser each emit therefrom a corresponding coating material flow 16, which may be a substantially continuous or discrete vacillating filament or an atomized spray, toward a corresponding strand in alignment with the orifice.

In FIG. 3, some of the orifices 13 are illustrated schematically at the origin of the corresponding flows 16 spaced apart evenly in a single row on the dispenser. The orifices may be recessed or protrude from the side 14 of the dispenser. In other embodiments, the spacing between adjacent orifices is not necessarily the same. Alternatively, there may be more than one row or series of orifices arranged in alignment with the direction of the strand so that more than one orifice dispenses coating material onto each strand. In other embodiments, the orifices of adjacent rows may be offset.

Coating material dispensers suitable for use with the present invention are disclosed for example in U.S. Pat. No. 5,902,540, entitled "Meltblowing Method and Apparatus" and in U.S. Pat. No. 5,904,298, entitled "Improved Meltblowing Method and System", both of which are assigned commonly with the present application. These preferred exemplary devices are capable of producing filaments and atomized spray patterns that vacillate predominately non-parallel to the axis of the strands and provide precise control over the coating material dispensed therefrom.

In one embodiment, illustrated in FIG. 3, the coating material dispenser 10 dispenses substantially continuous coating material filaments 17 having a repeating, generally omega shaped pattern from the orifices thereof, only one of which is illustrated, as disclosed more fully in co-pending U.S. application Ser. No. 09/143,883 entitled "Omega Spray Pattern And Method Therefor", which is assigned commonly with the present application and is incorporated herein by reference.

In other embodiments, the coating material dispenser may be a spiral spray nozzle having a single orifice that dispenses a corresponding spiral filament onto one or more strands, or alternatively some other coating material dispensing apparatus.

Figure 5:
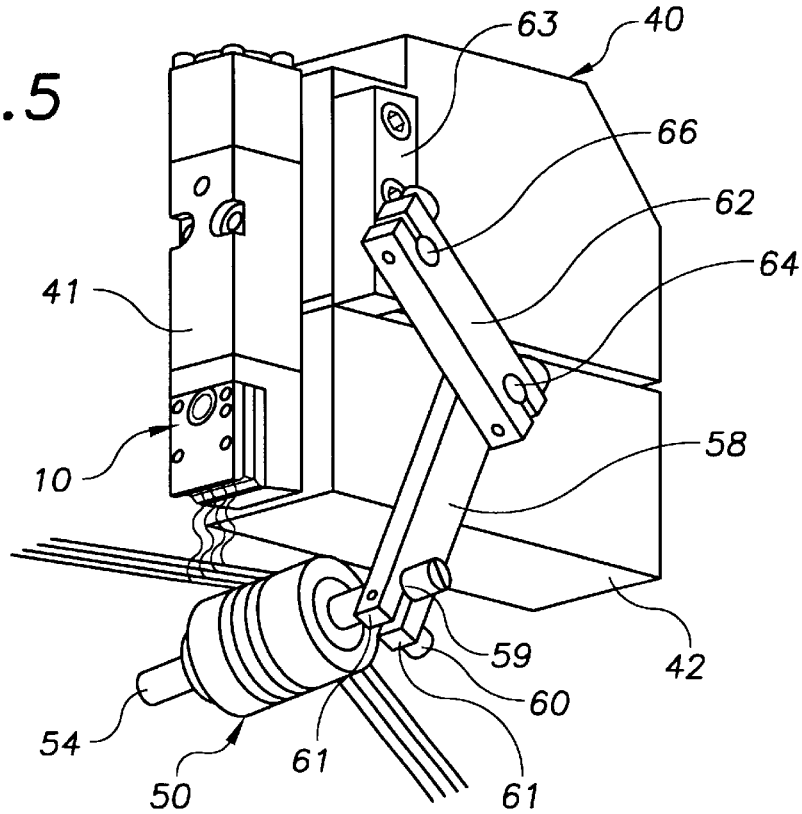
FIG. 5 is another view of an exemplary strand guide coupled to an exemplary strand coating applicator.

In FIG. 5, the exemplary coating material dispenser 10 is coupled to or mounted on an applicator head 40, which supplies coating material and in some embodiments heated air to the coating material dispenser, for example through a nozzle module 41, as is known generally by those having ordinary skill in the art.

In some applications, strands having coating material applied thereto are adhered to or deposited on a substrate moving relative to the coating material dispenser, usually in unison with the strands. The coating material dispenser however may move relative to the one or more strands and any substrate.

A strand guide having a guiding surface is preferably disposed adjacent the coating material dispenser, preferably on an upstream side thereof, to guide the strands past the coating material dispenser. The one or more strands are generally drawn over the guiding surface of the strand guide, which aligns the strands side by side in spaced apart relation relative to corresponding orifices of the coating material dispenser, for dispensing coating material dispensed therefrom onto the strands.

In the exemplary embodiment of FIG. 1, the strand guide is a rotatable strand guide roller 50 including a plurality of spaced apart grooves 52 disposed thereabout. The strands are each disposed in and guided along a corresponding groove. The spacing of at least some of the grooves generally corresponds with the spacing of the dispenser orifices. In the exemplary embodiment, the roller aligns and guides the strands adjacent a corresponding orifice of the coating material dispenser, as illustrated in FIG. 3. In alternative embodiments, coating material from a single orifice may be applied to multiple strands.

The strand guide is preferably coupled to the coating material dispenser, in fixed relation relative thereto. In the exemplary embodiment, the coating material dispenser and strand guide are both coupled to the applicator head, thereby eliminating or at least substantially reducing any misalignment therebetween, for example misalignment caused by vibrating machinery, as frequently occurs in prior art systems having the strand guide coupled to machinery other than the coating material dispenser.

Figure 2:
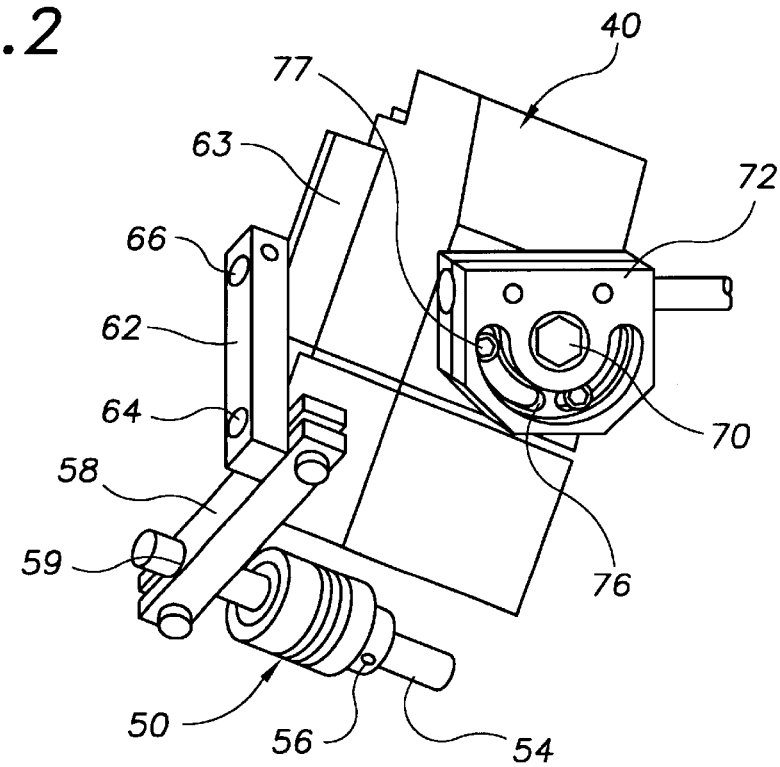
FIG. 2 is a partial view of a strand coating applicator.

In FIGS. 1, 2 and 5, the exemplary roller guide 50 is rotatably coupled to a roller axle or shaft 54, preferably with roller bearings. In FIGS. 1 and 2, the exemplary roller guide 50 is retained on the roller shaft 54 by a collar 56 fastened thereto with a set screw or other fastening means.

Figure 8:
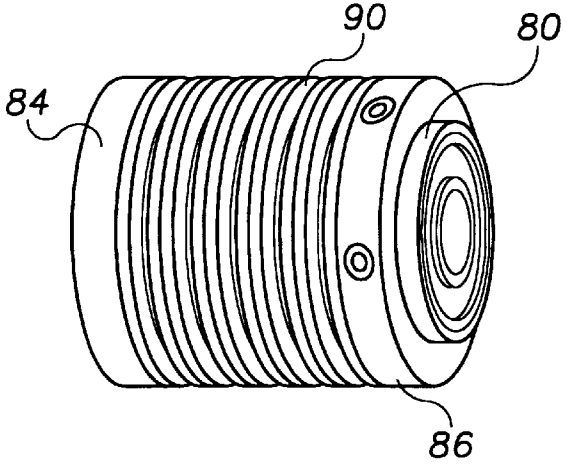
FIG. 8 is another exemplary strand guide roller.
Figure 6:
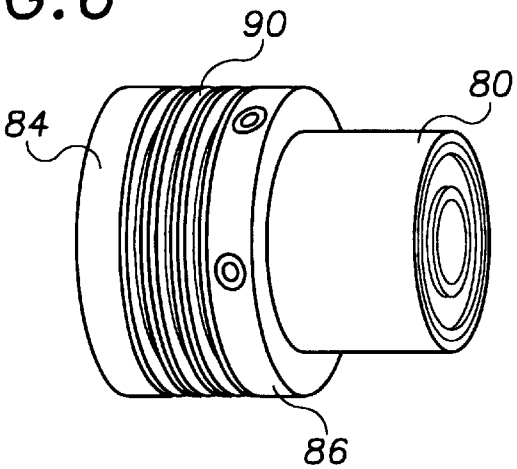
FIG. 6 is an exemplary strand guide roller.
Figure 10:
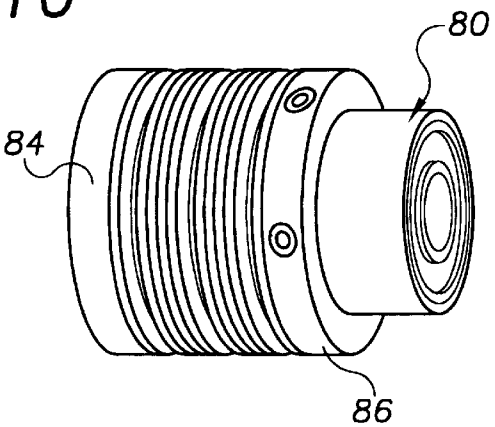
FIG. 10 is yet another exemplary strand guide roller.

The exemplary strand guide rollers of FIGS. 6, 8 and 10 are modular assemblies each configured differently from a limited set of components to accommodate different numbers of strands with different spacings therebetween.

Figure 7:
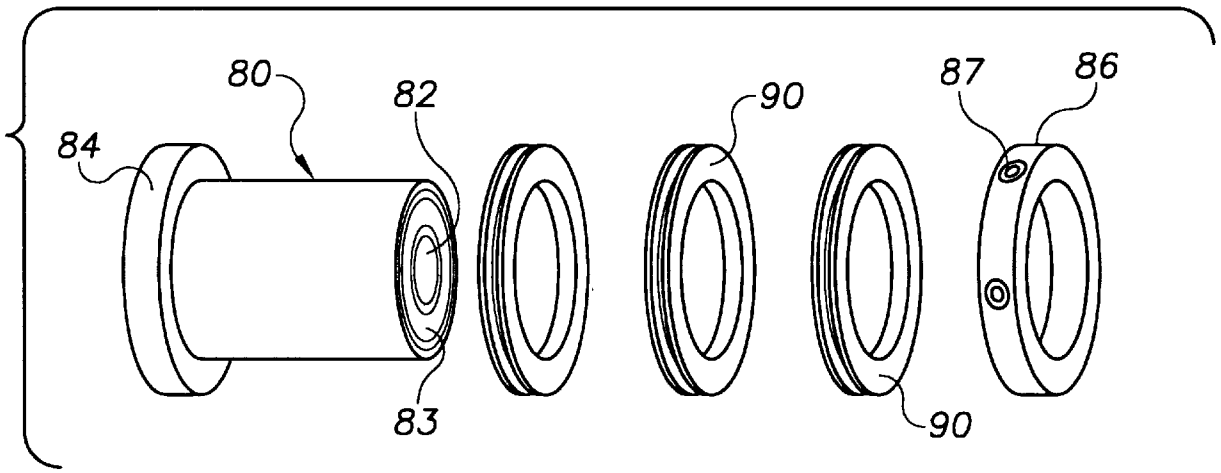
FIG. 7 is a disassembled view of the strand guide roller of FIG. 6.
Figure 9:
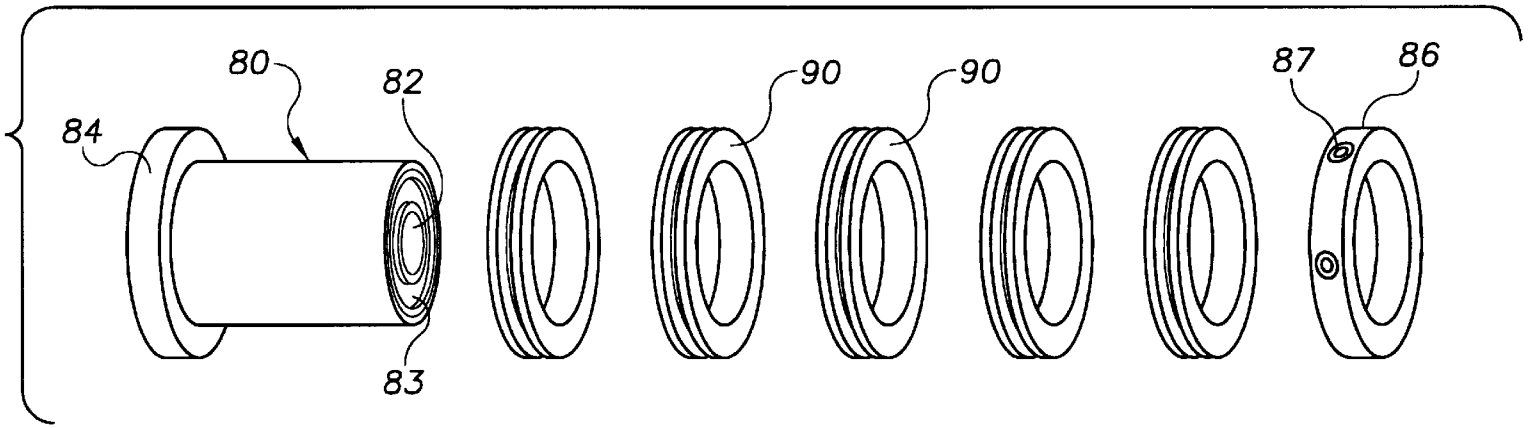
FIG. 9 is a disassembled view of the strand guide roller of FIG. 8.
Figure 11:
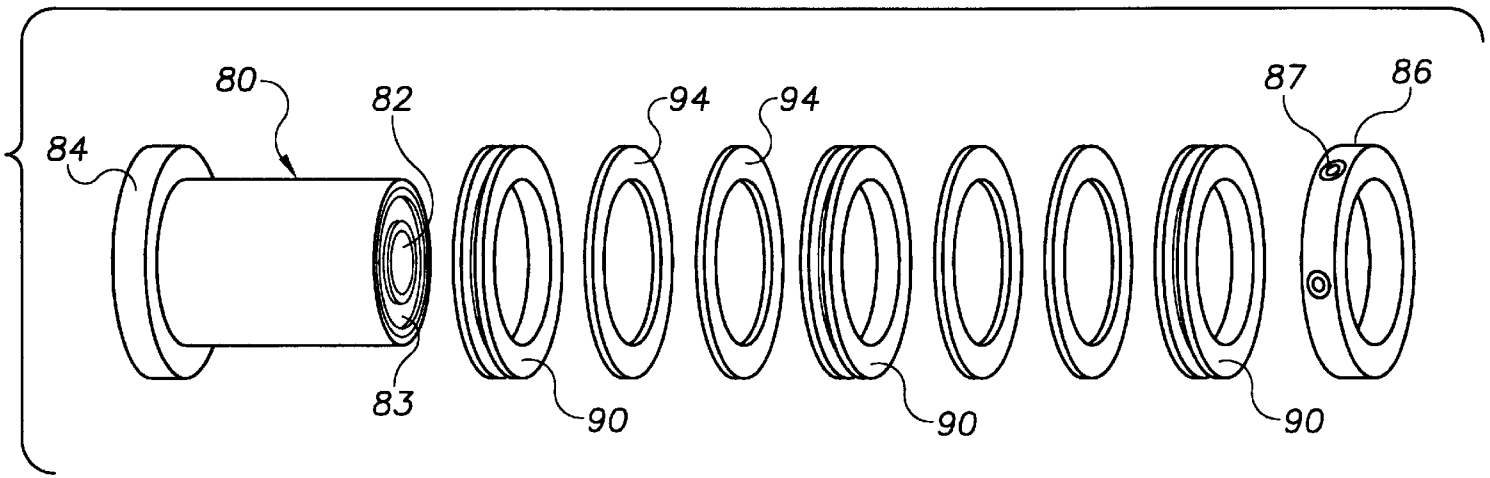
FIG. 11 is a disassembled view of the strand guide roller of FIG. 10.

In FIGS. 7, 9 and 11, which are disassembled views of FIGS. 6, 8 and 10 respectively, each strand guide roller is assembled about a hub 80 having an axial support opening 82 with bearings disposed thereabout, for example sealed bearings 83 located toward or at opposite ends of the axial support opening, only one of which is illustrated. A bushing may be a suitable equivalent for some applications. The hub 80 may thus be rotatably disposed about the roller shaft 54 as discussed above.

The exemplary hub 80 also includes a shoulder flange 84 toward or at one end thereof and a removable locking collar 86 retained about the hub by a set screw 87 or other retention member toward or at an opposite end of the hub. The exemplary shoulder 84 is an integral part of the hub, but in alternative embodiments it may be in the form of the removable locking collar or some other discrete member assembled with the hub.

In FIGS. 6–9, the strand guide rollers include a plurality of at least two strand guides 90 disposed about the hub and retained in side-by-side, or stacked relation, between the shoulder 84 and locking collar 86. In other embodiments, however, the strand guide rollers may include only a single strand guide.

Figure 12:
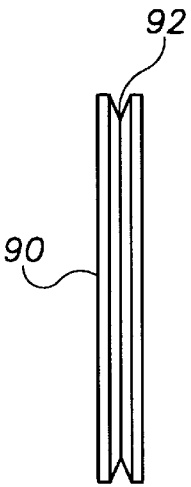
FIG. 12 is an end view of an exemplary annular strand guide.

In FIG. 12, the strand guide 90 is an annular member having at least one annular groove 92 disposed thereabout on an outer surface thereof.

The strand guides 90 also have a characteristic width that determines the spacing between adjacent grooves along the axis of the hub. For example, the strand guides 90 of FIGS. 6 and 7 are more narrow than the strand guides of FIGS. 8 and 9, thereby providing a closer strand spacing in FIG. 6.

In FIGS. 10 and 11, the strand guide roller includes annular spacers 94 between the plurality of strand guides 90, thereby further separating the spacing between grooves.

In an exemplary strand guide roller system suitable for guiding elastic and LYCRA strands used in the production of disposable diapers and other garments, the strand guides 90 are available in several widths, for example 3 mm, 4 mm and 5 mm widths and the spacer has a 1 mm width.

A variety of strand guide rollers having different numbers of grooves and different spacings therebetween may thus be configured with the limited number of components of the exemplary system. Other systems may include components having additional dimensions and/or other dimensions.

In FIGS. 2 and 5, the roller shaft 54 extends from a roller arm 58 adjustably coupled to the applicator head 40. The roller shaft is also preferably adjustably coupled to the roller arm, for example by threaded engagement with a threaded opening 59 of the roller arm 58. In the exemplary embodiment, the roller guide 50 and/or roller shaft 54 is adjustable in either direction along the axis of the shaft 54 to align the guide grooves of the roller 50 relative to the one or more orifices of the coating material dispenser.

In FIGS. 2 and 5, the roller arm 58 is pivotally coupled to a guide arm 62 by a pivot pin 64 extending from one or the other. The guide arm 62 is also preferably adjustably coupled to the applicator, for example by a pivot pin 66 extending from a bracket 63 mounted thereon.

In FIG. 5, the guide roller 50 may be adjustably positioned toward and away from a bottom side 42 the applicator head 40. The guide roller 50 may also be adjustably positioned in the upstream and downstream direction of the strands, closer or farther away from the dispenser.

In the exemplary embodiment of FIG. 5, the roller axle 54 is secured in the opening 59 of the roller arm 58 by a bolt 60 disposed through prongs 61 thereof, which are clamped about the shaft 54 upon tightening the bolt. The guide arm 62 is similarly secured to the pivot pin 66, and the roller arm 58 is similarly secured to the guide arm 62. In other embodiments, the guide roller is adjustably coupled to the applicator head by other structure.

In some embodiments of the invention, the strand guide is adjustably mounted on a pivot member to change the orientation of the guiding surface of the strand guide to vary the spacing of the strands relative to the substrate. The coating material dispenser is preferably adjustable in unison with the strand guide, for example by adjusting the position or orientation of the applicator head, to facilitate application of the coating material onto the strands.

Figure 4:
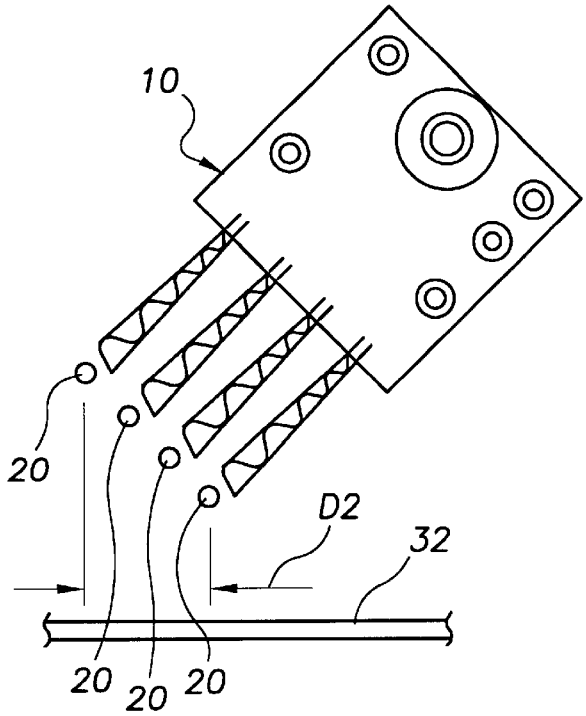
FIG. 4 is another partial view of an exemplary coating material dispenser in a second configuration.

In the exemplary embodiments of FIGS. 3 and 4, spacing between the plurality of strands 20 as they are deposited onto the substrate 30 is varied by changing the orientation of the strand guide, not illustrated, and particularly the guiding surface thereof relative to a surface 32 of the substrate. The plane of the strands 20 corresponds generally to the orientation of the guiding surface of the strand guide relative to the substrate surface 32.

In the embodiment of FIG. 1, the grooved guiding surface of the strand guide 50 is parallel to the substrate surface 32, so that the plane of the strands 20 is also parallel to the substrate, as illustrated best in FIG. 3. The spacing between adjacent strands relative to the substrate surface 32 thus corresponds generally with the spacing between the grooves on the strand guide over which the strands are drawn. In FIG. 3, for example the spacing between the outermost strands is D1.

In FIG. 4, the strand guide has been pivoted to orient the grooved guiding surface thereof at an angle relative to the substrate so that the plane of the strands is at a corresponding angle relative to the substrate. The spacing between adjacent strands relative to the substrate surface 32 is thus reduced in some proportion to the angle between the substrate and the guiding surface of the strand guide over which the strands are drawn. In FIG. 4, the spacing between the outermost strands disposed over an angled strand guide is D2, which is less than the spacing D1 in FIG. 3.

FIGS. 1 and 2 illustrate the applicator head 40 pivotally mounted on a pivot or bolt shaft 70 having an axis substantially transverse to the side by side arrangement of the plurality of orifices, which permits adjustment of the orientation of the coating material dispenser and strands, as illustrated in FIGS. 3 and 4. In FIGS. 3 and 4, the pivot axis of the coating material dispenser and strand guide is aligned substantially in a direction of the moving substrate, which moves into or out of the page of the drawing.

In FIGS. 1 and 2, the pivot shaft 70 extends through a mounting block 72 supported by a support member 74, in the exemplary form of a rod. In FIG. 2, the mounting block 72 includes one or more arcuate slots 76 disposed about the pivot shaft 70. A bolt 77 extends through the corresponding slot 76 and into a threaded bore of the applicator head 40.

Engagement of the bolt 77 with opposite end portions of the slot 76 limits pivoting or rotation of the applicator head 40 about the shaft 70, and engagement of a head portion of the bolt 77 with the mounting block 72 secures the orientation of the applicator head 40 relative thereto upon tightening the bolt 77.

While the foregoing written description of the invention enables one of ordinary skill to make and use what is considered presently to be the best mode thereof, those of ordinary skill will understand and appreciate the existence of variations, combinations, and equivalents of the specific exemplary embodiments herein. The invention is therefore to be limited not by the exemplary embodiments herein, but by all embodiments within the scope and spirit of the appended claims.

What is claimed is:

1. A strand coating apparatus comprising:

an applicator head;

a coating material dispenser coupled to the applicator head, the coating material dispenser having an orifice;

a strand guide roller coupled to the applicator head in spaced apart relation to the coating material dispenser, the strand guide roller having a hub and a strand guide disposed about the hub, the strand guide having a groove disposed thereabout adjacent the coating material orifice.

2. The apparatus of claim 1, a plurality of strand guides disposed in stacked relation about the hub, each strand guide having at least one corresponding groove thereabout.

3. The apparatus of claim 2, the coating material dispenser having a plurality of coating material orifices, each orifice of the coating material dispenser aligned with a corresponding groove of the strand guide roller.

4. The apparatus of claim 1, a support member, the applicator head pivotally coupled to the support member by a pivot member having an axis aligned non-parallel to a rotation axis of the hub.

5. The apparatus of claim 1, a roller shaft coupled to the applicator head, the hub rotatably disposed about the roller shaft.

6. The apparatus of claim 5, bearings rotatably coupling the hub to the roller shaft.

7. The apparatus of claim 5, the roller shaft extending from a roller arm pivotally coupled to a guide arm pivotally coupled to the applicator head.

8. The apparatus of claim 1, the hub having a shoulder flange thereon and a locking collar coupled thereto spaced apart axially from the shoulder flange, the strand guide disposed between the shoulder flange and the locking collar.

9. The apparatus of claim 2, a spacer between adjacent strand guides.

10. The apparatus of claim 2, the plurality of strand guides are substantially identical annular members removably disposed about the hub.

11. The apparatus of claim 10, the hub having a shoulder flange thereon and a locking collar removably coupled thereto spaced apart axially from the shoulder flange, the plurality of strand guides disposed between the shoulder flange and the locking collar.

12. A strand coating apparatus, comprising:

a coating material dispenser having at least one orifice;

a hub coupled to the coating material dispenser;

a strand guide disposed about the hub, the strand guide spaced apart from the coating material dispenser, the at least one orifice directed toward the strand guide, the strand guide having at least one annular groove disposed on an outer surface thereof.

13. The stand coating apparatus of claim 12, a plurality of strand guides disposed about the hub, each strand guide baying an annular groove disposed on an outer surface thereof, the grooves of the plurality of strand guides spaced apart along the axis of the hub.

14. The strand coating apparatus of claim 13, spacer between each of the plurality of strand guides.

15. The strand coating apparatus of claim 13, the hub having a shoulder flange thereon and a removable locking collar spaced apart axially from the shoulder flange, the plurality of strand guides disposed between the shoulder flange and the locking collar.

16. The strand coating apparatus of claim 12, the hub having a shoulder flange thereon and a removable locking collar spaced apart axially from the shoulder flange, the strand guide disposed between the shoulder flange and the locking collar.

17. The strand coating apparatus of claim 16, an axial support opening extending through the hub, bearings disposed in the hub about the axial support opening.

18. A strand coating apparatus, comprising:

a coating material dispenser;

a hub coupled to the coating material dispenser and spaced apart therefrom, the hub having a radial shoulder flange;

a locking collar removably disposed about the hub, the collar spaced axially from the shoulder flange;

a strand guide removably disposed about the hub between the shoulder flange and the removable collar, the strand guide having a corresponding annular groove disposed on an outer surface thereof.

19. The strand coating apparatus of claim 18, a plurality of strand guides disposed in stacked relation about the hub.

20. The strand coating apparatus of claim 19, a plurality of annular spacers, one or more of the spacers disposed between adjacent strand guides.

* * * * *